US007331369B2

(12) United States Patent
Cordova

(10) Patent No.: US 7,331,369 B2
(45) Date of Patent: Feb. 19, 2008

(54) SLIDING DOOR MAGNETIC LATCH

(76) Inventor: Carlos Cordova, 2113 E. Nura Pl., Anaheim, CA (US) 92806

( * ) Notice: Subject to any disclaimer, the term of this patent is extended or adjusted under 35 U.S.C. 154(b) by 373 days.

(21) Appl. No.: 11/143,851

(22) Filed: Jun. 1, 2005

(65) Prior Publication Data

US 2006/0272781 A1 Dec. 7, 2006

(51) Int. Cl.
*A47G 5/02* (2006.01)

(52) U.S. Cl. ..... 160/23.1; 160/122; 160/290.1; 160/DIG. 16

(58) Field of Classification Search ..... 160/122, 160/290.1, DIG. 16, 23.1, 26, 27, 28, 98, 160/99, 100; 292/251.5; 335/303, 219, 335/260

See application file for complete search history.

(56) References Cited

U.S. PATENT DOCUMENTS 3,425,729 A * 2/1969 Bisbing ..... 292/251.5
3,451,707 A * 6/1969 Barry ..... 292/251.5
3,976,316 A 8/1976 Laby
3,984,795 A 10/1976 Gaskill
4,271,892 A 6/1981 Brusseau et al.
4,418,951 A 12/1983 Schultz et al.
H43 H 4/1986 Michaels
4,651,793 A * 3/1987 Davlantes ..... 160/92
4,822,085 A 4/1989 Guity-Mehr
5,244,239 A 9/1993 Wang
5,251,362 A 10/1993 Riceman et al.
6,003,583 A * 12/1999 Lacoste et al. ..... 160/122
6,035,460 A 3/2000 Borter
6,478,070 B2 * 11/2002 Poppema ..... 160/23.1

* cited by examiner

*Primary Examiner*—Blair M. Johnson
(74) *Attorney, Agent, or Firm*—Gene Scott; Patent Law & Venture Group

(57) ABSTRACT

A magnet holder constructed of a resilient material as a plural-sided box has an open side. A bar magnet within the magnet holder extends outwardly from the open side. A second side of the box has an arcuate convex shape extending outwardly. A hollow door frame strut provides a first interior surface abutting a third side of the box. The magnet abuts a second interior surface of the strut with the second side of the box abutting a third interior surface such that the arcuate shape is flattened, springfully wedging the box between the first and second interior surfaces of the strut and securing the magnet holder in place within the strut.

2 Claims, 3 Drawing Sheets

SLIDING DOOR MAGNETIC LATCH

BACKGROUND

1. Related Applications none

2. Field of the Present Disclosure

This disclosure relates generally to magnetic latches for doors and more particularly for a magnet holder for securing a magnet in a sliding door and to a screen door therefor.

3. Description of Related Art

The following art defines the present state of this field and each disclosure is hereby incorporated herein by reference:

Brusseau, et al., U.S. Pat. No. 4,271,892, discloses a convertible door structure for hinged mounting in a conventional door frame and including bottom and upper panel portions normally bounded by opposed side stiles and top and bottom cross rails; the lower panel portion is fixed relative to the lower portions of the side stiles and the bottom cross rail. The upper panel portion is hinged along its bottom edge to the top edge of the bottom panel portion in a manner whereby it may be swung from its normal closed position, relative to the top halves of the side stiles and the top cross rail to an open position wherein it overlies the inner face of the bottom panel portion. A pocket or well is defined within the lower panel portion to store a generally conventional type of framed screen unit for selective removal and installation in the opening defined in the upper portion of the door when the upper panel portion is disposed in its down position.

Schultz et al, U.S. Pat. No. 4,418,951, discloses a rotary type of latch for sliding screen doors wherein the rotary member is molded from a plastic material such as a polycarbonate and which is rotatable in either direction for universal application to either right hand or left hand door operations. The rotary latch engages a slot in a door pull molded from a similar plastic material and contacts the screen door frame through the slot to cam the door against a retaining channel mounted on a door frame. The rotary latch includes a plurality of flat cam faces affording multiple locking positions and which necessitate positive lock rotation to enable the latch to be disengaged. This latch mechanism is of particular usefulness for application to sliding patio screen doors where the screen door closes into a pocket within the side jamb of the patio door frame.

Guity-Mehr, U.S. Pat. No. 4,822,085, discloses a rotatably adjustable two magnet door latch system. Ferro magnetic latching means are normally coupled to the edge of a door stop. A multi-part door latch assembly is coupled to the edge of the door adjacent the stop when the door is closed. The assembly comprises a first thin magnet having a straight edge and an opposite concave edge. A second generally planar thin magnet has a first convex edge of radius equal to and fitting into the concave edge of the first magnet. Rotating means rotate the second magnet. Magnetic flux is a function of the length of arcs of the magnets that are adjacent. One or more flux plates transmit flux from the magnets to the stop and a housing modularizes the assembly for easy installation and protection against dirt.

Wang, U.S. Pat. No. 5,244,230, discloses a latch assembly including a permanent magnet which is fixedly connected with a housing. A pair of pole pieces are connected with opposite poles of the permanent magnet. A coil extends around a portion one of the pole pieces. A keeper is mounted for pivotal movement between an initial position in which the keeper engages both of the pole pieces and a release position in which the keeper is spaced from the pole pieces.

The coil is energizable to oppose the permanent magnet and release the keeper for pivotal movement from the initial position to the release position. A retainer surface is connected with the keeper and retains a striker and door against movement relative to the housing when the latch assembly is in an engaged condition. The retainer surface and striker cooperate to transmit force along a path which extends through an axis about which the keeper pivots.

The retainer surface has an arcuate surface area with a center of curvature disposed on the axis about which the keeper pivots.

Borter, U.S. Pat. No. 6,035,460, discloses a pivotal door for an entrance or passageway, and particularly for shower and bath enclosures, comprising a plurality of frame members, a panel mounted in adjustable frame members, a channel provided for bottom frame members, and a pair of fixed pivot members retained within one of the adjustable frame members in a socket provided in the shower/bath enclosure frame, the adjustable side frame members being arranged to be affixed at any of a plurality of positions in the shower stall to enable the door to be utilized with enclosures having entrances of different widths.

Riceman et al, U.S. Pat. No. 5,251,362, discloses a magnetic latch including a first member having a protrusion and a second member engaging the protrusion to prevent the first member and the second member from sliding relatively to one another. The second member includes a first magnet to attract the first member and a first solid non-magnetic member located inside a cavity of the first magnet to enhance attraction between the first member and the second member. The second member can be provided with a backing plate to facilitate a magnetic flux path from the magnet to the magnet aperture. The second member can also include a second magnet to attract the first member and a second solid non-magnetic member located between the first magnet and the second magnet. A third solid non-magnetic member can be provided on the outer periphery of the magnets. This design provides a latch with stronger holding power.

Michaels, H43, discloses a copier with a copying platen, and platen cover unit pivotal thereover, which may comprise a document feeder, the platen cover unit having connecting pivotal lifting means, and a magnetic latch for magnetically latching the platen cover unit in a closed position closely overlying the copier platen with a magnetic flux field between the platen cover unit and the copier generated by at least one magnet on one completing a magnetic circuit through at least one magnetic flux conductive member on the other when the magnetic latch is closed, the magnetic latching of the platen cover unit in the closed position providing for document retention and illumination thereunder and magnetic resistance to opening of the platen cover unit by the lifting means, and with a switch for indicating closure of the platen cover unit, the improvement wherein the switch comprises a magnetic switch magnetically coupled to the magnetic latch, the magnetic switch being magnetically actuated in response to the change in magnetic flux field of the magnetic latch corresponding to the completion of the magnetic circuit through the magnetic flux conductive member, the magnetic switch providing a control signal to the copier in direct response to, and indicative of, the completed, positive, magnetic latching of the platen cover unit in the closed position.

Gaskill, U.S. Pat. No. 3,984,795, discloses, an electrically releasable permanent magnet latch which includes a magnetic tube disposed within a U-shaped magnetic frame. Disposed within the tube are a lightweight armature and a coil spring biasing the armature forward. An electromagnet coil is wound about the tube and a pair of permanent magnets are inside the frame outboard of the tube. Magnetic diverter plates abut the magnets and are interposed between the magnets and coil. A collar on the tube provides a direct magnetic bridge to the diverters. Energizing of the coil creates a flux which bucks the permanent magnet flux to permit the spring to overcome the armature holding force whereby the spring operates the armature.

Laby, U.S. Pat. No. 3,976,316, discloses a magnet which has a contact face, a registry edge and restraint apertures in which lodge resilient restraints of a magnet holder. The holder has snap fingers and locators for securing the holder to a door stop of a door frame, preferably in an indented section of the stop. The holder cavity has a rocker ridge contacting the registry edge of the magnet, and restraint fingers. The cavity walls, the restraint fingers and the limiting rocker ridge hold the magnet so its contact face has limited freedom to adjust for surface to surface contact with a catch plate or strike on a swinging door. Preferably the magnet holder is shaped with relief openings between the snap fingers, the locators, the cavity walls and the resilient restraint fingers to be conventionally moldable in one piece.

Our prior art search with abstracts described above teaches magnetic door latches, a rotary screen door latch, a convertible door structure with magnetic latch, a magnetic latch closure control, and a magnetic latch with extending drip rail system. However, the prior art fails to teach a permanent magnet holder capable of being inserted into a door frame with spring wedging. The present disclosure distinguishes over the prior art providing heretofore unknown advantages as described in the following summary.

SUMMARY

This disclosure teaches certain benefits in construction and use which give rise to the objectives described below.

This is a disclosure of a door apparatus for use in residential or commercial buildings. The apparatus can also be used for motor homes, on boats and in similar applications. Pocket doors are well known and when such doors are of rigid construction, they generally move to one side of the doorway and are concealed within the adjoining wall space. Screen doors also may function as pocket doors but the screen can be rolled up into a pocket mounted at one side of a door jam.

Such pocket screen doors may comprise a single screen that is pulled across the doorway from one side to the other or may comprise two screens that pull from opposing sides of the doorway and abut at the center of the doorway. In all cases, such doors must latch. Many types of latches are found in the prior art, but of particular convenience are magnetic latches wherein the door may be moved into contact with a magnet or may itself carry a magnet and be moved into a latch plate made of a ferromagnetic material such as steel. However, such magnets require particular effort, labor and diligence to install on or within door frames. Ideally, it is preferably to place a magnet within the moving portion of a pocket door since it is then out of sight, cannot acquire dust or dirt, and appears to latch magically. Magnets may be installed within a door frame, but it is difficult to bond them in place within the frame and if not bonded will often move out of alignment due to door slamming, etc. The present invention overcomes this difficulty by using a plastic magnet carrier that is held in place within the door frame by wedging action as will be described in detail below.

A magnet holder is constructed of a resilient material, preferably a plastic, as a plural-sided box having a first side open. A bar magnet is inserted through the open side into the holder and protrudes outwardly from the first side of the box. A second side of the box has an arcuate convex shape extending outwardly from the box. A door frame strut, used for screen doors, provides a first interior surface which abuts a third side of the box. The magnet abuts a second interior surface of the strut with the second side of the box abutting a third interior surface such that the arcuate shape is flattened and thereby springfully wedges the box between the first and second interior surfaces of the strut securing the magnet in place. The door frame strut is preferably used for doors that are latched by magnetic attraction between magnets or between magnets and steel strike plates.

A primary objective inherent in the above described apparatus and method of use is to provide advantages not taught by the prior art.

Another objective is to provide a screen door that is magnetically latched.

A further objective is to provide such a screen door wherein the magnet is located within the door and is held in place by a spring wedge.

A still further objective is to provide such a spring wedge that is capable of engaging a magnet.

Other features and advantages of the described apparatus and method of use will become apparent from the following more detailed description, taken in conjunction with the accompanying drawings, which illustrate, by way of example, the principles of the presently described apparatus and method of its use.

BRIEF DESCRIPTION OF THE DRAWINGS

The accompanying drawings illustrate at least one of the best mode embodiments of the present apparatus and method of it use. In such drawings.

DETAILED DESCRIPTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 5:
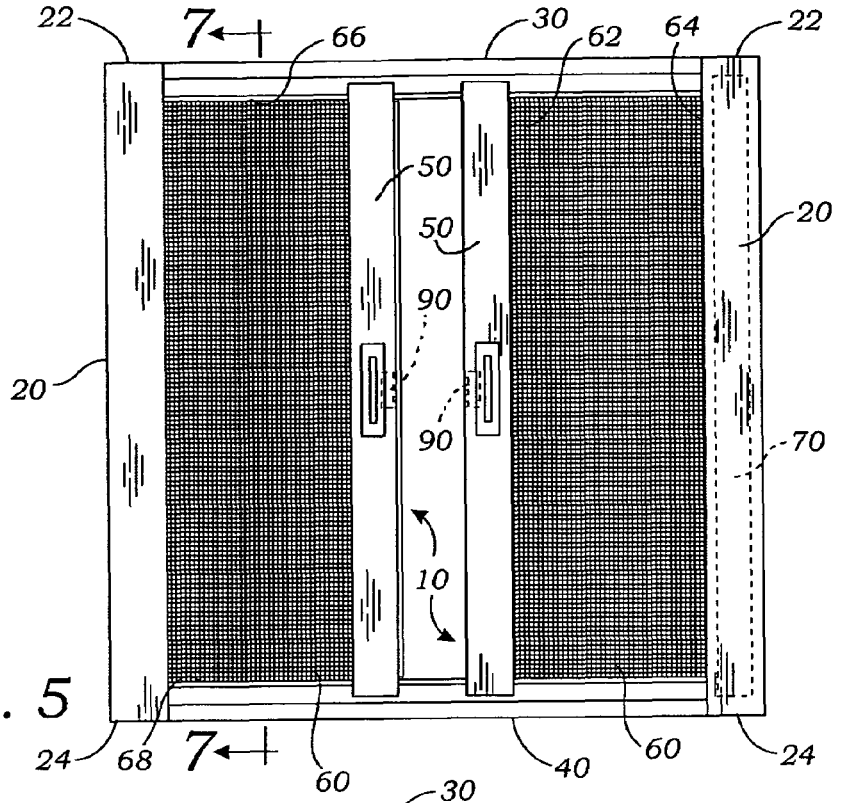
FIG. 5 is a front elevational view of a double screen door showing the location of magnets in opposing door frame struts with the door adjar.
Figure 6:
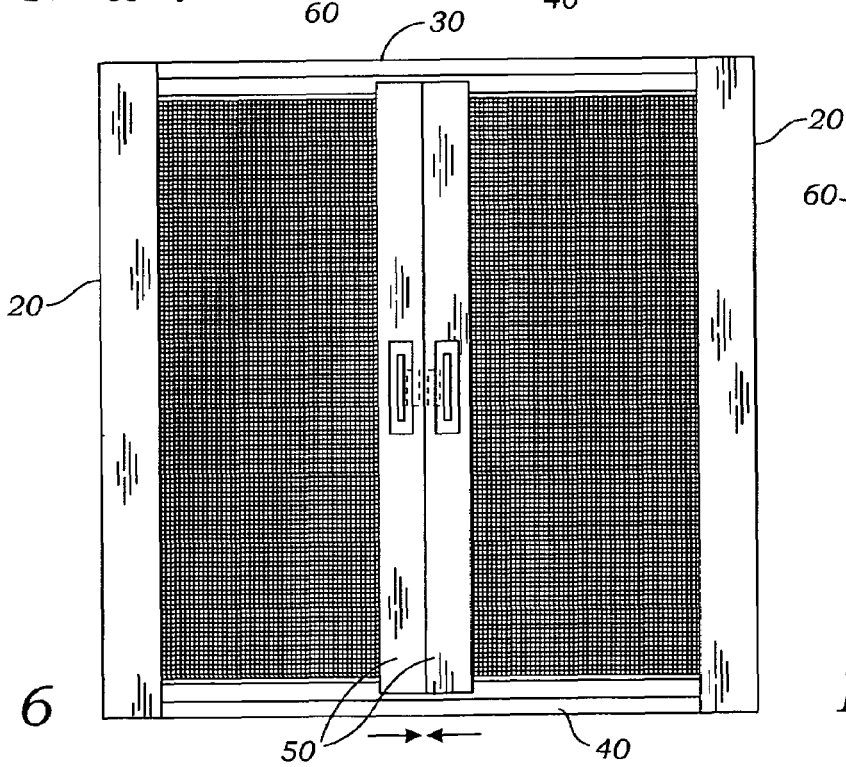
FIG. 6 is the front elevational view of FIG. 5 showing the door frame struts in mutual contact.
Figure 7:
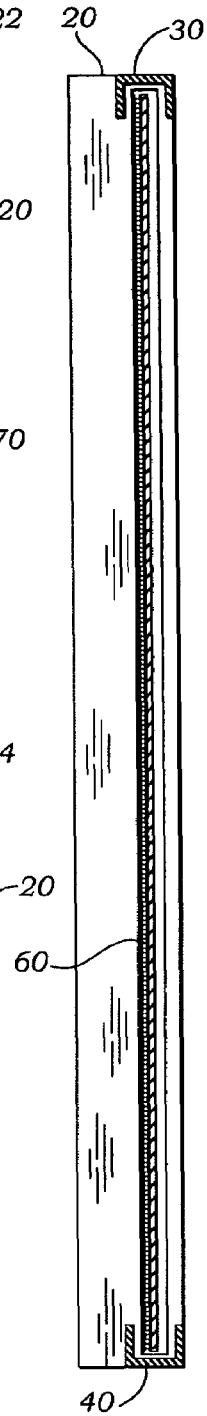
FIG. 7 is a sectional view taken along line 7-7 in FIG. 5.

The present description defines a magnetic latching apparatus for a screen door or door pair, however, such a latching apparatus may also be used for solid doors for closing doorways, ceiling openings, cabinets and similar applications. As shown in FIGS. 5 and 6, a typical double set of screen doors 10 comprises a pair of spaced apart vertical screen pockets 20 which are mounted to a door frame (not shown), a horizontal upper slide channel 30 secured between terminal upper ends 22 of the screen pockets 20, a horizontal lower slide channel 40 secured between terminal lower ends 24 of the screen pockets 20, a pair of hollow vertical door frame struts 50 slidingly engaged between the upper and the lower slide channels 30 and 40, and a pair of flexible screen cloths 60. This arrangement is well known in the art and is common.

Figure 1:
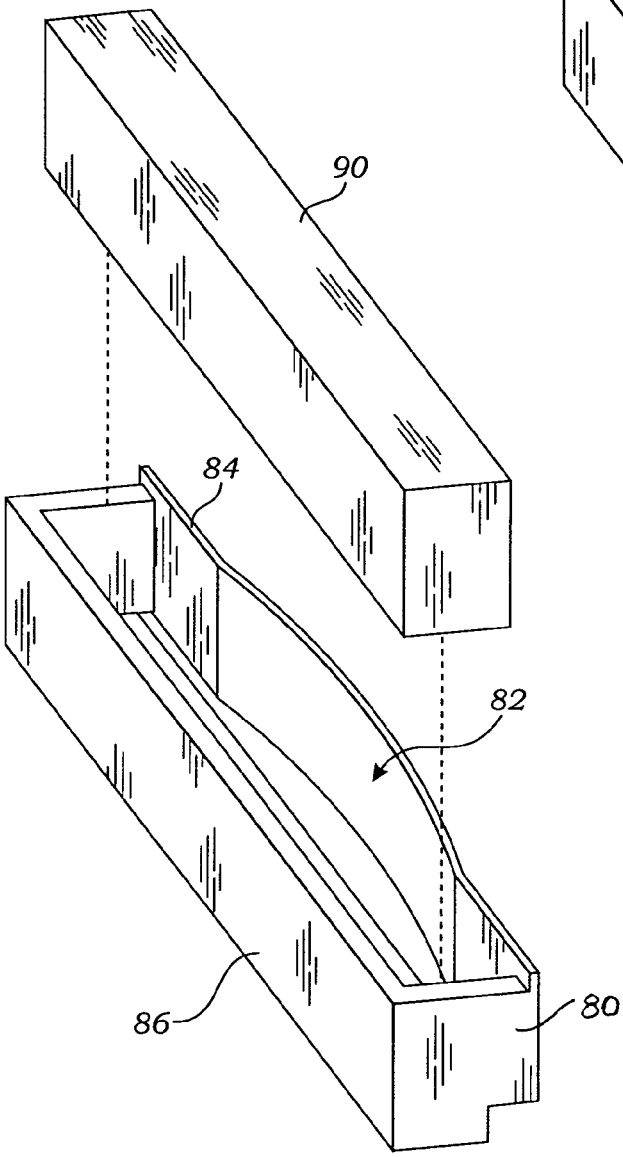
FIG. 1 is an exploded perspective view of the present apparatus magnet holder and bar magent.
Figure 2:
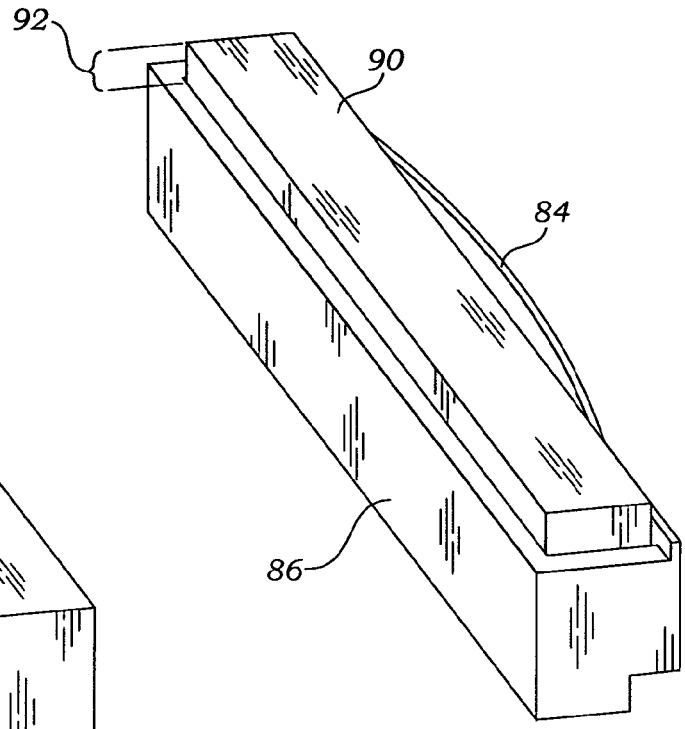
FIG. 2 is the perspective view of FIG. 1 showing the bar magnet engaged within the holder.
Figure 3:
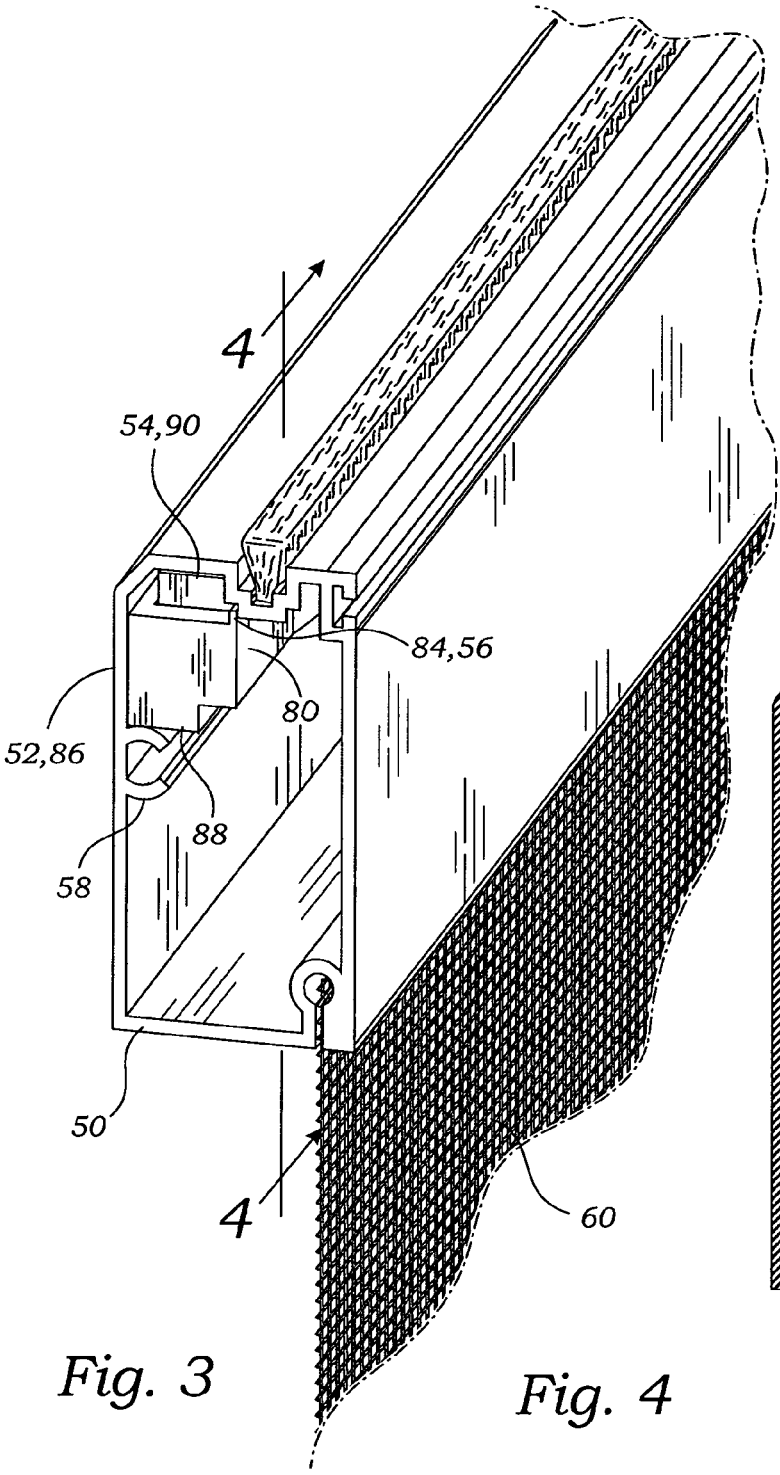
FIG. 3 is a top cutaway perspective view of a door frame strut showing the assembly of FIG. 2 inserted.
Figure 4:
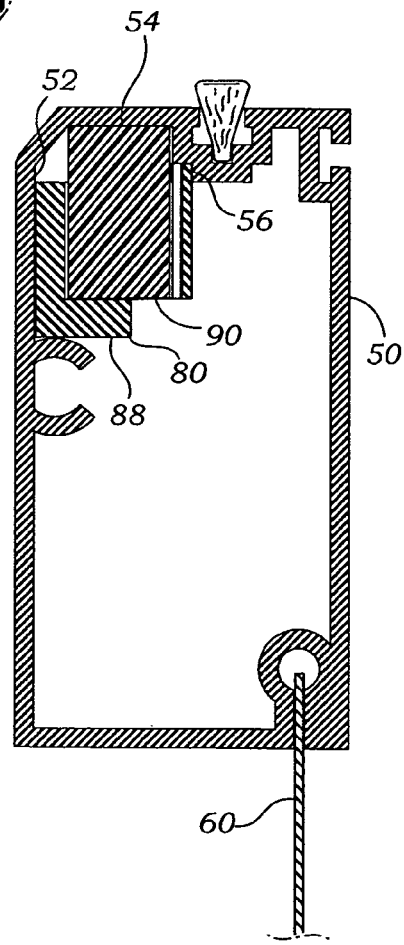
FIG. 4 is a sectional view taken along line 44 in FIG. 3.

Both of the screen cloths 60 have one vertical edge 62 secured to one of the door frame struts 50 as best seen in FIGS. 3 and 4. An opposing vertical edge 64 is secured to a rollup device 70 within one of the screen pockets 20. Each one of the screen cloths 60 further has an upper horizontal edge 66 positioned within the upper slide channel 30 and a lower horizontal edge 68 positioned within the lower slide channel 40. Both of the frame struts 50 have one or more magnet holders 80 positioned therewithin as shown in FIGS. 3 and 4. The magnet holder 80 is constructed of a resilient material such as plastic or other non-magnetic material, as a plural-sided box as shown in FIG. 1. A first side 82 of the box is open as best seen in FIG. 1, and a bar magnet 90 is placed within the magnet holder 80 through this open side 82, with a portion 92 of the magnet 90 protruding outwardly from the first side 82 of the magnet holder as best shown in FIG. 2. A second side 84 of the box has an arcuate convex shape extending outwardly from the magnet holder 80, as best seen in FIG. 1. The reason for this critical relationship will become clear in the further discussion. The door frame struts 50 each provide a first interior surface 52 abutting a third side 86 of the magnet holder 80, while the magnet 90 abuts a second interior surface 54 of the strut 50 and the second side 84 abuts a third interior surface 56, such that its arcuate shape is flattened, springfully wedging the magnet holder 80, with its magnet 90, between the first 52 and third 56 interior surfaces of the strut 50. Preferably a fourth side 88 of the box is forced against an outcropping 58 of the strut 50 (FIG. 4) so as to restrain the magnet holder 80 within the strut 50. When one screen door is used, the magnet 90 is normally placed at the vertical center of the strut 50 and in line with a strike place (not shown) mounted on a door jam. This arrangement is not illustrated. When a double set of doors is used, as shown in FIGS. 5 and 6, one of the bar magnets 90 is mounted within each of the struts 50 and positioned in mutual vertical adjacency with a north pole of one of the magnets 90 in opposition to a south pole in the other of the magnets 90. Of course, plural magnet sets may be used to achieve greater latching strength.

It is noted here that in the above description and in the claims to follow the use of singular or plural are interchangeable. For instance when referring to a screen door in the singular, what is meant is either a single door or double doors.

When the magnet holders 80 are placed within the struts 50, the compressive forces on the holders 80 provide for holding power so that the holders 80 do not move when the screen doors are operated.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An apparatus comprising: a magnet holder constructed of a resilient material as a plural-sided box with a first side of the box open; a bar magnet within the magnet holder protruding outwardly from the first side of the box; a second side of the box having an arcuate convex shape protruding outwardly from the box; a hollow door frame strut providing a first interior surface abutting a third side of the box; the magnet abutting a second interior suface of the strut and the second side the box abutting third interior suface of the strut such that the arcuate shape is flattened, springfully wedging the magnet holder between the first and second interior surfaces of the strut.

2. The apparatus of claim 1 further comprising: a vertical screen pocket for mounting to a door frame; a horizontal upper slide channel secured at an upper end of the screen pocket; a horizontal lower slide channel secured at a terminal lower end of the screen pocket; the door frame strut slidingly engaged between the upper and the lower slide channels; a flexible screen cloth having one vertical edge thereof secured to the door frame strut and an opposing vertical edge secured to a rollup device within the screen pocket; the screen cloth further having an upper horizontal edge positioned within the upper slide channel and a lower horizontal edge positioned within the lower slide channel.

* * * * *